United States Patent [19]

Chambers et al.

[11] Patent Number: 4,917,252

[45] Date of Patent: Apr. 17, 1990

[54] NURSING BOTTLE ASSEMBLY

[76] Inventors: Debra Chambers, Rte. 3, Box 85-B, Warren, Ark. 71671; Donald R. Russell, 2017 Archdale St., Broken Arrow, Okla. 74014

[21] Appl. No.: 341,559

[22] Filed: Apr. 21, 1989

[51] Int. Cl.[4] ..... A61J 9/00; A61J 11/00; A61J 11/04

[52] U.S. Cl. ..... 215/11.1; 215/344

[58] Field of Search ..... 215/11.1–11.6, 215/100 A, 343, 344; 220/90.2

[56] References Cited

U.S. PATENT DOCUMENTS

| | | | |
|---|---|---|---|
| D. 264,993 | 6/1982 | Kestenberg | 215/11 |
| 1,510,363 | 9/1924 | Wangen | 215/11.1 |
| 1,617,213 | 2/1927 | La Paugh | 215/11 |
| 1,701,566 | 2/1929 | Havins | 215/11.1 |
| 1,859,733 | 5/1932 | Fort | 215/11.1 |
| 1,999,581 | 4/1935 | Yager | 215/11 |
| 2,105,170 | 1/1938 | Tarrant | 215/11 |
| 2,196,870 | 4/1940 | Little | 128/252 |
| 2,495,548 | 1/1950 | Revane | 215/11 |
| 2,803,365 | 8/1957 | Allen | 215/11 |
| 2,822,102 | 2/1958 | Holland | 215/11 |
| 3,092,276 | 6/1963 | Schaar | 215/11 |
| 3,112,837 | 12/1963 | Manoyian | 215/11 |
| 3,833,141 | 9/1974 | Leitz | 215/344 |
| 3,881,627 | 5/1975 | Davolt | 215/344 X |
| 3,990,596 | 11/1976 | Hoftman | 215/11 |
| 4,557,392 | 12/1985 | Ryan et al. | 215/100 A X |
| 4,613,050 | 9/1986 | Atkin et al. | 215/11.5 |

FOREIGN PATENT DOCUMENTS

| | | | |
|---|---|---|---|
| 164339 | 7/1955 | Australia | 215/343 |
| 288584 | 5/1953 | Switzerland | 215/11.5 |
| 29063 | of 1911 | United Kingdom . | |

*Primary Examiner*—Sue A. Weaver

*Attorney, Agent, or Firm*—Banner, Birch, McKie & Beckett

[57] ABSTRACT

A nursing bottle assembly including a nipple member having at least two openings and an outer annulus and an inner annulus which both extend downwardly from an end at a widest of the openings of the nipple member. The assembly also includes a bottle member having at least one opening and an upper portion adjacent the opening of the bottle member. The upper portion includes an outer upwardly extending projection with external threads and an inner upwardly extending projection. The inner projection is spaced from the outer projection at a distance sufficient for receiving the outer annulus of the nipple member between the inner and the outer projections of the bottle member to substantially prevent sidewise movement of the widest opening end of the nipple member relative to the bottle member. In addition, the assembly includes a securing ring having an internally threaded portion which is engaged with the external threads of the bottle member outer projection. The securing ring also has a flange extending over the nipple member a distance sufficient to substantially prevent the widest opening end of the nipple member from being pulled vertically away from the bottle member.

20 Claims, 3 Drawing Sheets

NURSING BOTTLE ASSEMBLY

BACKGROUND OF THE INVENTION

1. Field of the Invention

This invention relates to nursing bottle assemblies. More particularly, the invention relates to the relationship between a nipple member, a bottle member and a securing ring.

2. Description of the Prior Art

On large diameter nipple nursing bottle assemblies, it is important that the nipple be retained under a securing ring when the nipple tip is pulled in a direction vertically away from the bottle or sidewise relative to the bottle by the user.

In conventional nursing bottle assemblies, an end of a nipple opposite to the tip effectively being used as a gasket between the securing ring and bottle member when the securing ring is connected to the bottle member. With the securing ring to bottle member connection most likely being a threaded engagement with the nipple member acting as a gasket, the nipple member possibly undergoes both excessive lateral forces across and excessive downward forces on an upper surface of the nipple member when the securing ring is threadedly engaged with the bottle member. By acting as a gasket and, thus, possibly undergoing these forces applied between the ring and bottle, the nipple member could buckle or bunch up. This buckling may likely result in a leak of milk, formula, water or the like.

For example U.S. Pat. No. 2,822,102 to Holland discloses a threaded ring which is disposed over a nipple rim while the ring is being threadedly secured to a bottle. Upon attachment of the threaded ring, a groove on the nipple upper surface is engaged by a downwardly projecting bead of the ring. A portion of the nipple rim is then forced downward over a sharp lip of the bottle and an outer portion of the nipple rim is compressed by the ring as the ring is exerting downward and lateral forces on the nipple member rim.

In U.S. Pat. No. 2,495,548 to Revane a nursing bottle assembly screw cap includes an annular portion and internal annular flanges which are mounted between flanges of a nipple when the screw portion of the cap is screwed downwardly onto the threaded neck of the bottle.

In U.S. Pat. No. 3,092,276 to Schaar a retaining cap has internal screw threads which screw on to external threads of a bottle and which also clamp the nipple flange between the underside of a flange and the rim of the bottle.

These three references illustrate the potential problem with using an end of a nipple member to serve as a gasket between a bottle and a securing ring connection. Since this nipple end possibly undergoes excessive lateral forces across and downward forces on its upper surface as the ring is screwed over the nipple end, there is a reasonable likelihood of buckling the nipple end and introducing leaking.

SUMMARY OF THE INVENTION

It is an object of the invention to provide a nursing bottle assembly with a relationship between a nipple member, bottle member and securing ring which substantially prevents excessive lateral and downward forces on a nipple member outer end to effectively reduce the likelihood of the nipple member buckling and leaking.

It is another object of the invention to provide a nursing bottle with a nipple member having an end substantially prevented from sidewise movement relative to the bottle by the bottle itself.

It is another object of the invention to have a downwardly extending annulus on a nipple member outermost end be received in a recess of a bottle member before a securing ring is attached.

These and other objects can be obtained by a preferred nursing bottle assembly comprising a nipple member having at least two openings and an outer annulus and an inner annulus which both extend downwardly from an end at a widest of the openings of the nipple member. The preferred assembly also includes a bottle member having at least one opening and an upper portion adjacent the opening of the bottle member. The upper portion includes an outer upwardly extending projection with external threads and an inner upwardly extending projection. The inner projection is spaced from the outer projection at a distance sufficient for receiving the outer annulus of the nipple member between the inner and the outer projections of the bottle member to substantially prevent sidewise movement of the widest opening end of the nipple member relative to the bottle member. In addition, the assembly includes a securing ring having an internally threaded portion which is engaged with the external threads of the bottle member outer projection. The securing ring also has a flange extending over the nipple member a distance sufficient to substantially prevent the widest opening end of the nipple member from being pulled vertically away from the bottle member.

The various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive manner, in which there is illustrated and described preferred embodiments of the invention.

DETAILED DESCRIPTION OF THE PREFERRED EMBODIMENTS

Figure 1:
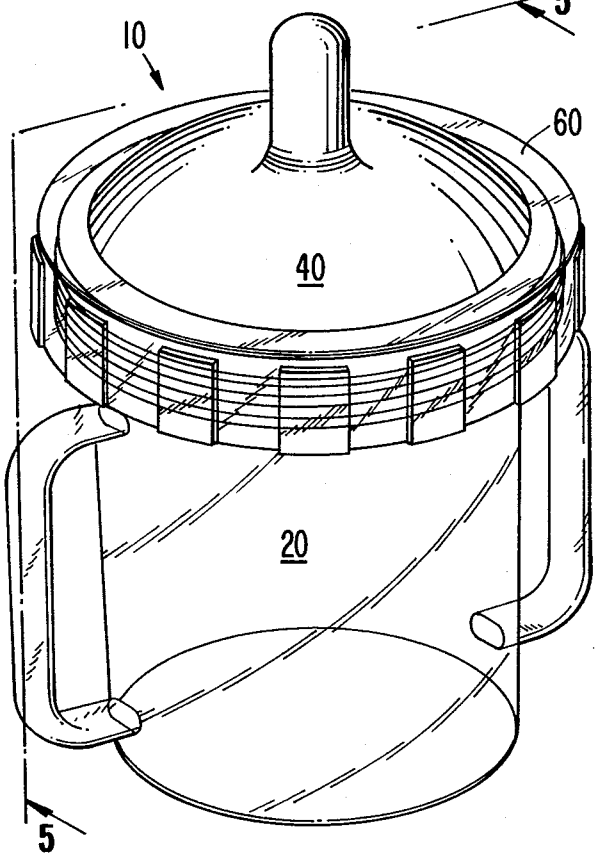
FIG. 1 is a perspective view of the nursing bottle assembly nipple member, bottle member and securing ring.

Shown in FIG. 1 is an embodiment of a nursing bottle assembly 10 of a generally cylindrical shape, having a bottle member 20 of transparent, unbreakable, somewhat flexible material for receiving milk, formula, water or the like. Also included is a nipple member 40 which is generally of a relatively large diameter having a broadened and flattened base with a short-depth tip. The nipple member base is preferably designed to simulate the shape of a woman's breast and nipple. Disposed adjacent the bottle member and nipple member is a securing ring 60.

Figure 2A:
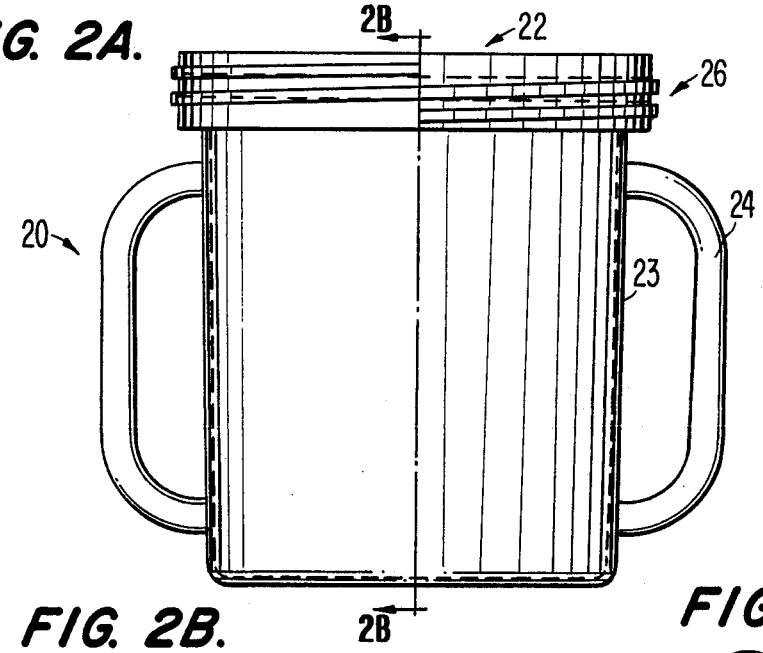
FIG. 2A is a side view of the bottle member of the assembly.

In FIG. 2A, the preferred bottle member 20 has an opening 22 and an outer surface 23 having a pair of handles 24. Above the handles 24 and adjacent the open end 22 is an upper portion 26. The handles 24 are especially advantageous in such a large diameter nipple nursing bottle assembly, because they allow one to easily hold the relatively wide mouth bottle.

Figure 2B:
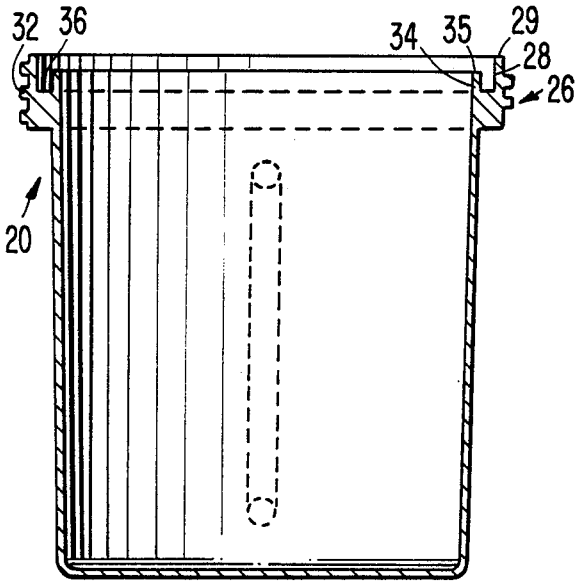
FIG. 2B is a sectional side view along line 2B—2B of FIG. 2A

As seen in FIG. 2B, the upper portion 26 has an outer upwardly extending projection 28 with external threads 32 and a substantially flat top surface 29. The upper portion also includes an inner upwardly extending projection 34 which can also have a substantially flat surface 35. The inner projection defines, in combination with the outer projection 28, a circumferential recess 36 between the inner and outer projections.

Figure 3A:
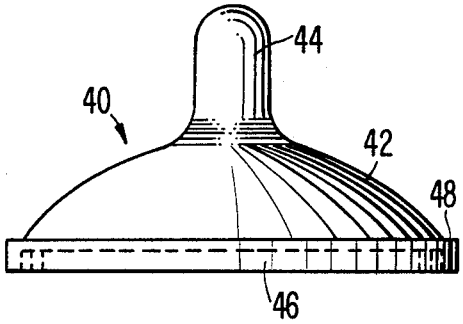
FIG. 3A is a side view of a nipple member of the assembly.

As shown in FIG. 3A, the preferred nipple member 40 has a broadened base 42. A tip 44 is disposed interiorly of the base and a rim 46 is disposed around the nipple member base. The nipple member base 42 is preferably of a relatively large diameter of greater than two inches and the tip is preferably of a shortened depth of approximately less than one inch.

Figure 3B:
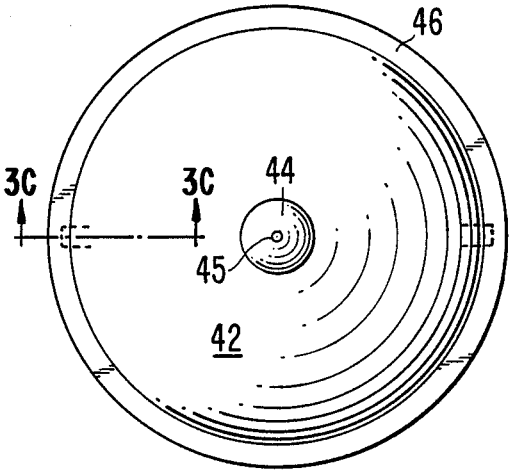
FIG. 3B is a top view of the nipple member of FIG. 3A.

Illustrated in FIG. 3B is the nipple member tip 44 about an opening 45 which is preferably at a center of the nipple member. In the sectional view of FIG. 3C, the preferred nipple member rim 46 is shown disposed around the widest opening 41 of the nipple member and the base 42 is shown disposed interiorly of this rim. This rim 46 has an upper side 48 which is substantially flat. At the outer end of the rim 46 is an outer annulus 54. Also, an inner annulus 56 can be extending downwardly from an inner end of the nipple member opening 41. This inner annulus can define, in combination with the outer annulus 54, a circumferential groove 58 of the nipple member.

Figure 3D:
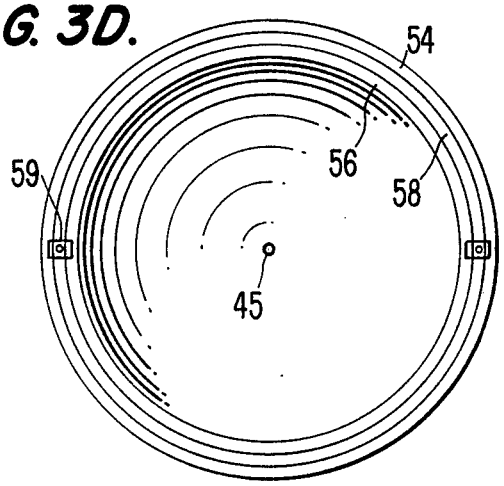
FIG. 3D is a bottom view of the nipple member of FIG. 3A.
Figure 3C:
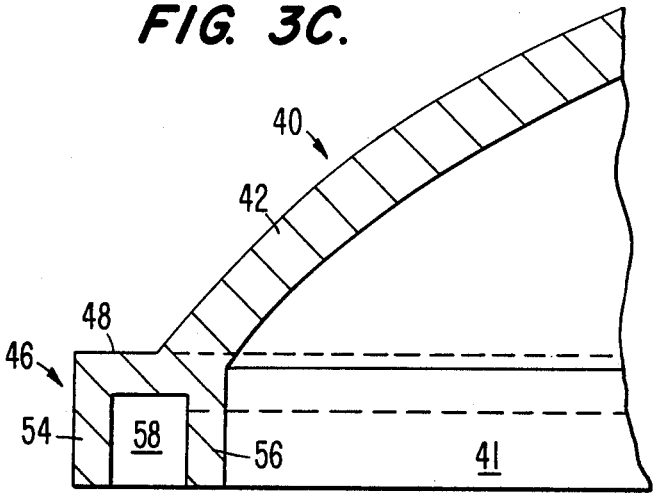
FIG. 3C is a sectional view along line 3C—3C of FIG. 3B illustrating the nipple member rim and two downwardly extending annuluses of the nipple member.

FIG. 3D further illustrates the downwardly extending annuluses 54 and 56 defining this groove 58. It is preferable to use silicone material for the nipple, because, among its many advantages, silicone allows for precise molding dimensions of the width of these two downwardly extending annuluses.

Also shown in FIG. 3D are venting grooves 59 at each of two opposite portions of both annuluses to partially define the air venting path. To form these venting grooves, both annuluses are made narrower and the groove is made deeper. In addition, as seen in FIG. 3D, pin-size holes can be cut in the rim in communication with the venting grooves to further enhance air venting.

Figure 4A:
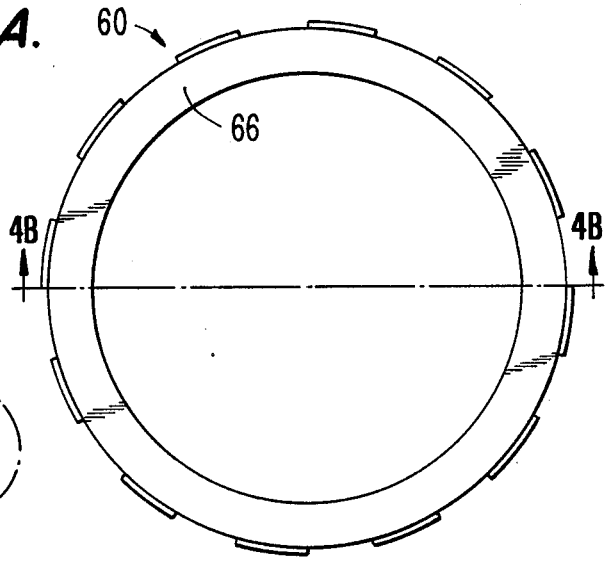
FIG. 4A is top view of the securing ring.
Figure 4B:
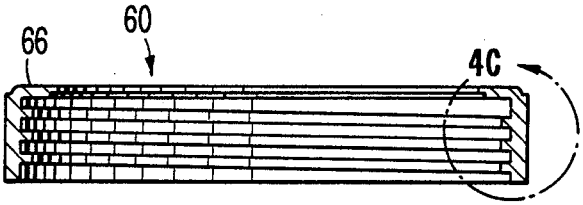
FIG. 4B is a sectional side view along line 4B—4B of FIG. 4A.
Figure 4C:
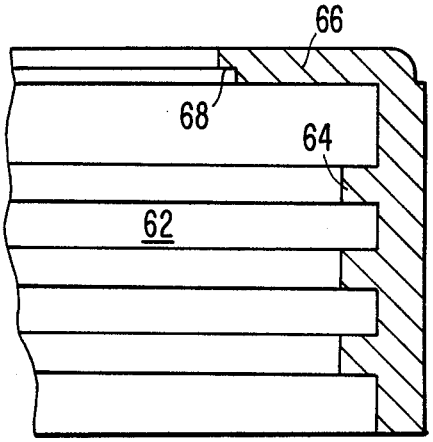
FIG. 4C is an enlargement of circle 4C in FIG. 4B illustrating the securing ring threads and inwardly extending flange.

Shown in FIGS. 4A through 4C is a securing ring 60 with an interior surface 62 having threads 64. Also on the securing ring is a flange 66 which extends inwardly. This flange 66 has a stepped end 68 for receiving an optional dust cap cover (not shown).

Figure 5:
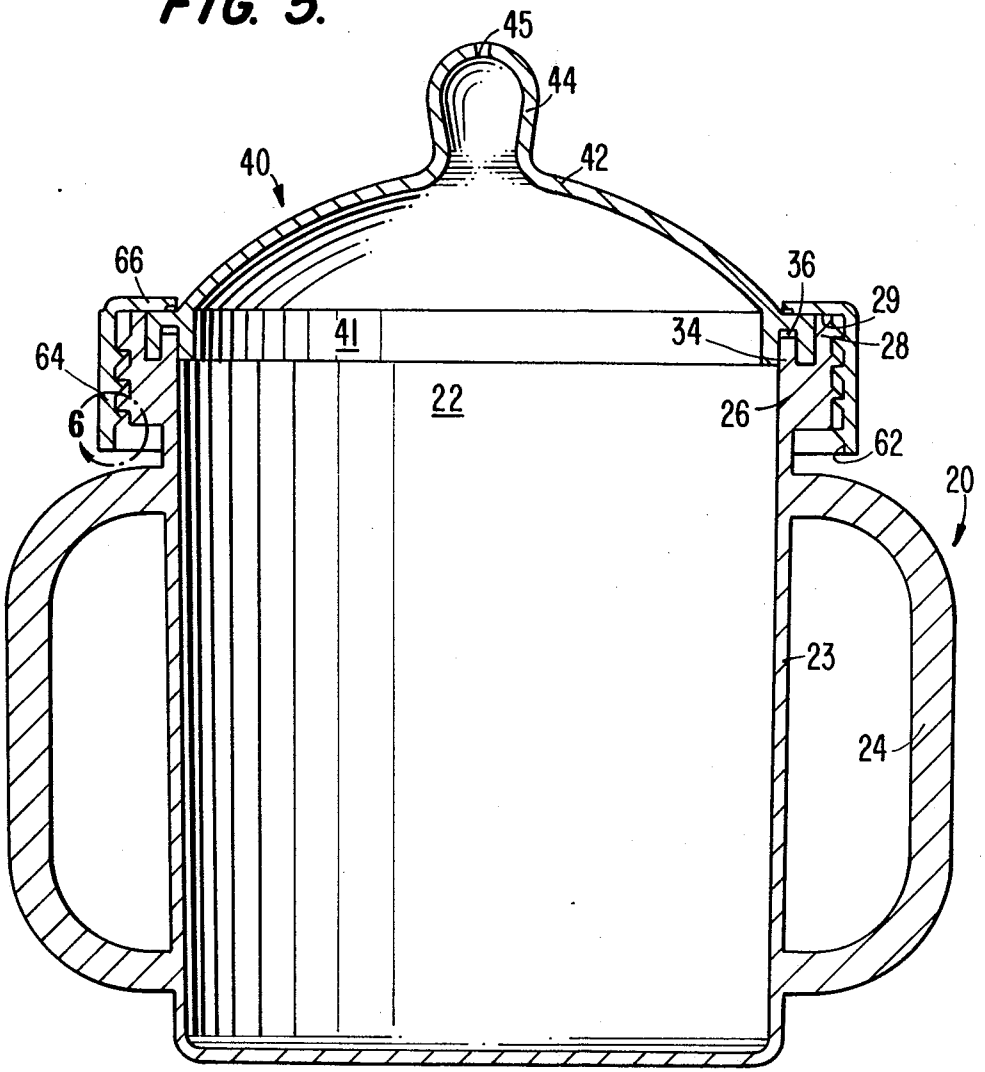
FIG. 5 is a sectional side view along line 5—5 of FIG. 1 illustrating the preferred relationship between the nipple member, bottle member and securing ring.

FIG. 5 illustrates the relationship between the nipple member, the bottle member and the securing ring. In FIG. 5, the nipple member 40 extends no further outward than the recess 36 formed between the outer projection 28 and the inner projection 34 of the bottle member upper portion 26. The nipple member is preferably not extending out past the circumferential recess of the bottle member to reduce the likelihood of the nipple member contacting the securing ring threads 64 during securing ring engagement.

Also, the upper portion inner projection 34 is spaced from the outer projection 28 a distance sufficient for the recess 36 to be able to receive the nipple member outer annulus 54. This arrangement preferably substantially prevents sidewise movement of the nipple member widest opening end, which preferably is defined by the rim 46. This substantial prevention of sidewise movement is thereby obtained before the securing ring is even applied. As mentioned, having a silicone nipple provides the advantage of being able to make the outer annulus 54 of the nipple member meet the tolerances required to perform this function.

The nipple also preferably includes an inner annulus 56. This inner annulus is preferably disposed interiorly of and adjacent to the inner projection 34 of the bottle member. In combination, the outer and inner annuluses of the nipple member can be effectively interlocked with the outer and inner projections of the bottle member to further enhance the ability to prevent sidewise movement of the nipple member before the securing ring is applied.

Figure 6:
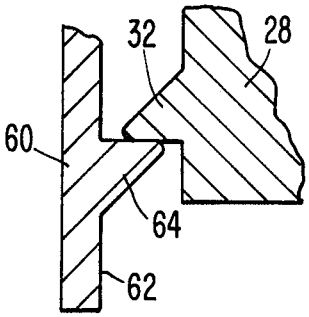
FIG. 6 is an enlargement of circle 6 in FIG. 5 illustrating a portion of the threaded engagement between the securing ring and the bottle member.

As illustrated in FIGS. 5 and 6, the securing ring interior surface 62 is then threadedly engaged with the outer projection external threads 32. With this threaded engagement, the external inwardly directed flange 66 of the securing ring is disposed on and extends a sufficient distance over the nipple member to substantially prevent the nipple member from being pulled vertically away from the bottle member upper portion. Preferably, this flange 66 of the securing ring is disposed on a substantially flat upper side surface 48 of the rim 46 and a substantially flat top surface 29 of the bottle member outer projection 28.

Having grooves 59 in the underside of the annuluses of the nipple, helps define a path for venting air up through the circumferential recess of the bottle member and through the outer diameter of the bottle member external threads when milk, water or the like is being pulled to the nipple.

Therefore, the nipple member 40 is not being used as a gasket for the securing ring and bottle member connection, it does not engage the outer sides of the bottle, and it is not disposed against the threads or projections of the securing ring. Instead, the nipple member 40 is preferably disposed in a circumferential recess of the bottle member. With the sidewise movement of the nipple member relative to the bottle substantially prevented before the securing ring is even attached and with the securing ring flange preferably resting on the upper side surface of the nipple member rim, the lateral and downward forces along the upper side of the nipple member rim are not excessive when the securing ring is threadedly engaged with the bottle member. Therefore, the likelihood of buckling of this nipple member is reduced and the consequence of leaking from this assembly is minimized.

While the invention has been described in connection with what is presently considered to be the most practically and preferred embodiment, it is understood that the invention is not to be limited to the disclosed embodiment, but on the contrary, it is intended to cover various modifications and equivalent arrangements included within a sphere and scope of the appended claims.

We claim:

1. A nursing bottle assembly comprising:

a nipple member having at least two openings and an outer annulus which extends downwardly from an end at a widest of said openings of said nipple member;

a bottle member including at least one opening and an upper portion adjacent said opening of said bottle member, said upper portion having:

an outer upwardly extending projection with external threads; and an inner upwardly extending projection, said inner projection is spaced from said outer projection at a distance sufficient for receiving said outer annulus of said nipple member between said inner and said outer projections of said bottle member to substantially prevent sidewise movement of said widest opening end of said nipple member relative to said bottle member; and a securing ring having an internally threaded portion engaged with said external threads of said bottle member outer projection and a flange extending over said nipple member a distance sufficient to substantially prevent said widest opening end of said nipple member from being pulled vertically away from the bottle member;

wherein said nipple member further comprises an inner annulus which extends downwardly from the widest of said openings of said nipple member to define, with said outer annulus, a circumferential groove between the outer and inner annulus of said nipple member and said inner annulus is disposed interiorly of said inner projection of said bottle member upper portion.

2. A nursing bottle assembly as in claim 1, wherein said nipple member is made of silicone.

3. A nursing bottle assembly as in claim 1, wherein said bottle member outer projection further comprises a substantially flat top surface and said securing ring flange is disposed on said substantially flat top surface of said bottle member outer projection.

4. A nursing bottle assembly as in claim 1, wherein said nipple member partially defines at least one venting path formed by the circumferential groove being wider and deeper along at least one portion than along the remainder of the groove.

5. A nursing bottle as in claim 1, wherein said widest opening end of said nipple member further comprises a rim from which at least said outer annulus extends downwardly from and said rim includes an outwardly directed upper side on which said securing ring extends at least partially over.

6. A nursing bottle assembly as in claim 5, wherein said upper side of said nipple member rim is substantially flat.

7. A nursing bottle assembly as in claim 5, wherein said nipple member further comprises a base member which is disposed interiorly of said rim and shaped to simulate a woman's breast and a tip which is disposed interiorly of said base member, disposed about one of the nipple member openings and is shaped to simulate a woman's nipple.

8. A nursing bottle assembly as in claim 7, wherein said bottle member further comprises an outer side surface disposed below said upper end portion and having at least one handle.

9. A nursing bottle assembly as in claim 1, wherein said nipple member further comprises a base member disposed interiorly of said outer annulus, said base member having a diameter of greater than two inches.

10. A nursing bottle assembly comprising:

a nipple member having at least two openings and an outer annulus which extends downwardly from an end at a widest of said openings of said nipple member;

a bottle member including at least one opening and an upper portion adjacent said opening of said bottle member, said upper portion having:

an outer upwardly extending projection with external threads; and an inner upwardly extending projection, said inner projection is spaced from said outer projection at a distance sufficient for receiving said outer annulus of said nipple member between said inner and said outer projections of said bottle member to substantially prevent sidewise movement of said widest opening end of said nipple member relative to said bottle member;

a securing ring having an internally threaded portion engages with said external threads of said bottle member outer projection and a flange extending over said nipple member a distance sufficient to substantially prevent said widest opening end of said nipple member from being pulled vertically away from the bottle member;

wherein said nipple member extends no further outwardly than the space between said outer and inner projections of said bottle member upper portion.

11. A nursing bottle assembly comprising:

a bottle member including at least one opening and an upper portion adjacent said opening of said bottle member, said upper portion having:

an outer upwardly extending projection with external threads; and an inner upwardly extending projection defining, in combination with said outer projection, a circumferential recess between said projections;

a nipple member having at least two openings including:

a rim disposed around a widest of the openings of said nipple member and having an upper side;

a base member disposed interiorly of said rim;

a tip disposed interiorly of said base member and about one of the nipple member openings; and an outer annulus extending downwardly from an outer end of said rim and disposed in said recess of said bottle member upper portion; and a securing ring including:

an internally threaded portion engaged with said threads of said bottle member outer projection; and a flange extending over at least a portion of said upper side of said nipple member rim;

wherein said nipple member further comprises an inner annulus extending downwardly from an inner end of said rim and disposed interiorly of said inner projection of said bottle member upper portion.

12. A nursing bottle assembly as in claim 11, wherein said upper side of said nipple member rim is substantially flat.

13. A nursing bottle assembly as in claim 11, wherein said nipple member is made of silicone.

14. A nursing bottle assembly as in claim 11, wherein said bottle member outer projection further comprises a substantially flat top surface and said securing ring flange is disposed on said substantially flat top surface of said bottle member outer projection.

15. A nursing bottle as in claim 11, wherein said bottle member further comprises an outer side surface disposed below said upper end portion and having at least one handle.

16. A nursing bottle assembly as in claim 11 wherein said nipple member inner annulus is disposed adjacent said inner projection of said bottle member upper portion and said outer and inner annuluses interlock with said bottle member outer and inner projections to substantially prevent sidewise movement of said rim of said nipple member relative to said bottle member.

17. A nursing bottle as in claim 11, wherein said nipple member base is shaped to simulate a woman's breast and said nipple member tip is shaped to simulate a woman's nipple.

18. A nursing bottle assembly as in claim 11, wherein said base member of said nipple member has a diameter of greater than two inches.

19. A nursing bottle assembly comprising:

a bottle member including at least one opening and an upper portion adjacent said opening of said bottle member, said upper portion having:

an outer upwardly extending projection with external threads; and an inner upwardly extending projection defining, in combination with said outer projection, a circumferential recess between said projections;

a nipple member having at least two openings including:

a rim disposed around a widest of the openings of said nipple member and having an upper side;

a base member disposed interiorly of said rim;

a tip disposed interiorly of said base member and about one of the nipple member openings; and an outer annulus extending downwardly from an outer end of said rim and disposed in said recess of said bottle member upper portion; and a securing ring including:

an internally threaded portion engaged with said threads of said bottle member outer projection; and a flange extending over at least a portion of said upper side of said nipple member rim;

wherein said nipple member rim extends no further outwardly than the circumferential recess defined between said outer and inner projections of said bottle member upper portion.

20. A nursing bottle assembly comprising:

a bottle member including at least one opening, an upper portion adjacent to said opening and an outer side surface disposed below said upper portion having at least one handle, said upper portion having:

an outer upwardly extending projection having an external surface with threads and a top surface which is substantially flat; and an inner upwardly extending projection defining, in combination with said outer projection, a circumferential recess between said projections;

a silicone nipple member having at least two openings, extending no further outward than the circumferential recess defined between said outer and inner projections of said bottle member and including:

a rim disposed around a widest of the openings of said nipple member and having an upper side which is substantially flat;

a base member disposed interiorly of said rim and having a shape which simulates a woman's breast;

a tip disposed interiorly of said base member, disposed about one of said nipple member openings and having a shape which simulates a woman's nipple;

an outer annulus extending downwardly from an outer end of said rim and disposed in said recess of said bottle member upper portion; and an inner annulus extending downwardly from an inner end of said rim and disposed interiorly of and adjacent to said inner projection of said bottle member upper portion, wherein said nipple member outer and inner annuluses interlock with said bottle member outer and inner projections to substantially prevent sidewise movement of said rim of said nipple member relative to said bottle member; and a securing ring including:

an internally threaded portion engaged with said threads of said bottle member outer projection; and a flange extending over said upper side of said nipple member rim a distance sufficient to substantially prevent said nipple member from being pulled vertically away from the bottle member.

* * * * *